United States Patent [19]

Wells, Jr.

[11] 4,390,063

[45] Jun. 28, 1983

[54] GEOTHERMAL WELLHEAD PACKING ASSEMBLY

[75] Inventor: Frederic D. Wells, Jr., Shreveport, La.

[73] Assignee: W-K-M Wellhead Systems, Inc., Shreveport, La.

[21] Appl. No.: 265,310

[22] Filed: May 20, 1981

[51] Int. Cl.[3] ..... E21B 33/03; F16L 17/02; F16L 21/04; F16L 27/12

[52] U.S. Cl. ..... 166/84; 166/88; 166/90; 277/30; 277/125; 285/187; 285/302

[58] Field of Search ..... 166/75 R, 82, 84, 89, 166/86, 88, 302, 303, 90, 173; 285/302, 187, 106; 277/3, 27, 123-125, 30, 31

[56] References Cited

U.S. PATENT DOCUMENTS

| | | | |
|---|---|---|---|
| 2,615,952 | 10/1952 | Rifenburg | 285/106 X |
| 3,944,263 | 3/1976 | Arnold | 285/106 X |
| 3,976,130 | 8/1976 | Chambless et al. | 166/84 |
| 4,299,395 | 11/1981 | Reed | 277/31 X |

*Primary Examiner*—Stephen J. Novosad
*Attorney, Agent, or Firm*—Marvin J. Marnock

[57] ABSTRACT

A geothermal wellhead assembly (22) has a casing head (26). An inner casing (12) within the casing head has a restrained lower end portion and an unrestrained upper end portion extending above the casing head. An expansion spool (28) is mounted on the upper end of the casing head and receives the upper end portion of the inner casing. An expansion sleeve (92) fits within the expansion spool. The outer surface (94) of the expansion sleeve is adjacent the inner surface (60) of the expansion spool and an annular space (98) is defined by the inner surface (96) of the expansion sleeve and the outer surface (76) of the inner casing. A packing assembly (108) is mounted within the annular space and extends in sealing relation between the inner casing and the expansion sleeve. The packing assembly is movable with the upper end portion of the inner casing as the inner casing moves longitudinally in response to temperature changes within the wellhead.

30 Claims, 10 Drawing Figures

GEOTHERMAL WELLHEAD PACKING ASSEMBLY

BACKGROUND OF THE INVENTION

This invention relates to geothermal wellheads and to packing assemblies positioned inside the wellhead to seal between the wellhead and an inner wellhead casing as the casing moves up and down in response to changes in thermal conditions in the wellhead. U.S. Pat. No. 3,976,130, issued Aug. 24, 1976, and assigned to the same assignee as the present application, describes packing means for a geothermal wellhead assembly by which a seal is effected between a casing and a bore within the wellhead, the seal being maintained throughout longitudinal movement of the casing in response to temperature changes within the wellhead. While the packing means described in the above noted patent does produce an effective seal, further study revealed the need for a packing assembly which was not as difficult to install, could be used with a number of casing expansion programs and permitted the use of different types and configurations of seals.

SUMMARY OF THE INVENTION

One object of the present invention is to provide a packing assembly for effecting a seal within a geothermal wellhead, the seal being formed between an inner casing within the wellhead and an expansion spool and the seal being maintained throughout longitudinal movement of the inner casing produced by temperature changes within the wellhead.

A second object of the present invention is to provide an expansion sleeve within the wellhead with which a seal is more readily effected and more easily maintained.

A third object of this invention is the provision of a packing assembly which is easier to install in geothermal wellheads than previous assemblies, thus reducing down time of a geothermal wellhead rig.

Another object of this invention is a mechanical seal activating apparatus which permits a broad range of seal types and seal configurations to be used in a geothermal wellhead.

Still another object of the present invention is to reduce the height of the packing assembly so a much shorter expansion spool is needed as compared to the height of those used in the past.

Yet another object of the present invention is a packing assembly which can be used for more than one casing expansion program, for example, a packing assembly which can be used for both an eight (8) inch and fourteen (14) inch expansion per casing program.

A further object of the invention is to reduce the total cost of a total expansion spool package.

Briefly, a geothermal wellhead assembly has a casing head and an inner casing within the casing head. The inner casing has restrained lower end portion and an unrestrained upper end portion extending above the casing head. An expansion spool is mounted on the upper end of the casing head and receives the upper end portion of the inner casing. An expansion sleeve fits within the expansion spool. The outer surface of the expansion sleeve is adjacent the inner surface of the expansion spool and an annular space is defined by the inner surface of the expansion sleeve and the outer surface of the inner casing. A packing assembly is mounted within the annular space and extends in sealing relation between the inner casing and the expansion sleeve. The packing assembly is movable with the upper end portion of the inner casing as the inner casing moves longitudinally in response to temperature changes within the wellhead. In other embodiments of the invention a packing assembly is used without an expansion sleeve and different packing assembly structures are described.

Various other objects, advantages and features of this invention will be apparent from the following discussion, taken in conjunction with the accompanying drawings, in which:

DESCRIPTION OF THE DRAWINGS

Corresponding reference characters indicate corresponding parts throughout the several views of the drawings.

DESCRIPTION OF PREFERRED EMBODIMENTS

Figure 1:
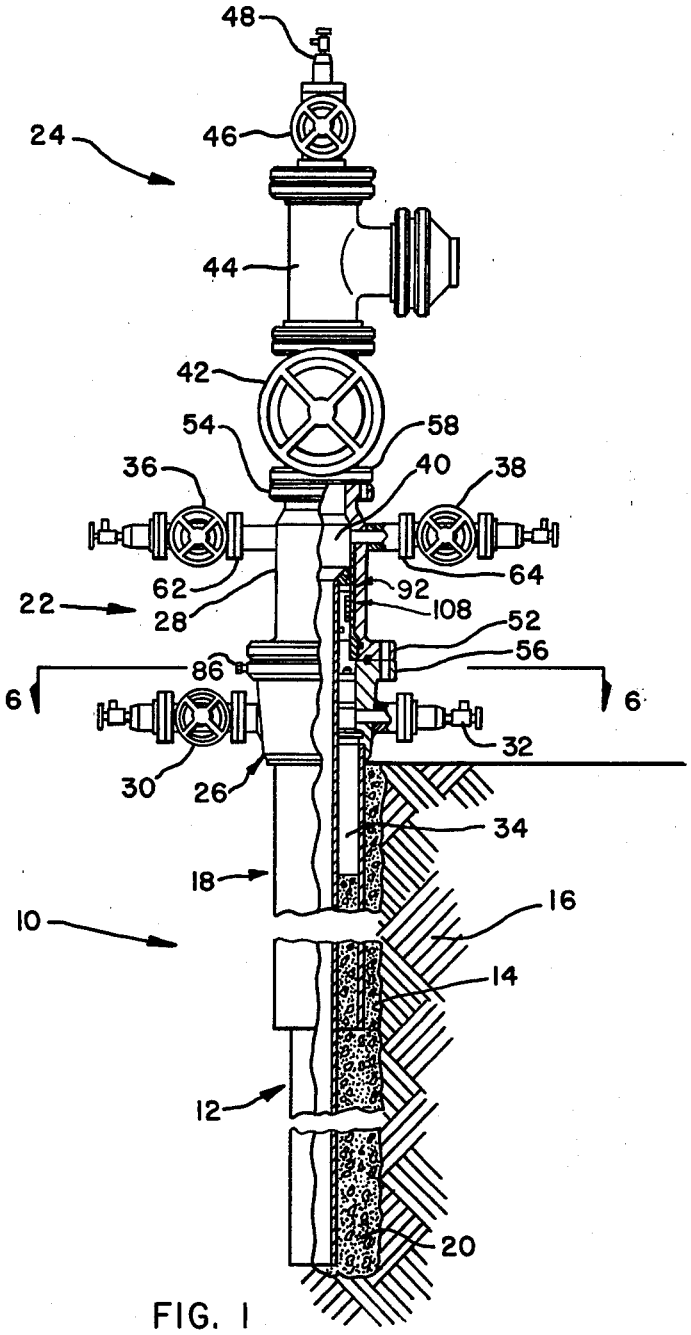
FIG. 1 is a sectional and partially cutaway view of a geothermal wellhead and christmas tree showing a casing and surface casing in their cemented positions in a well hole.

Referring to the drawings, a geothermal well 10 includes a surface casing 18 and an inner production casing 12 mounted in a hole 14 in the ground 16. The surface casing 18 extends through the water bearing formation of the ground and is cemented in place by cement 20. As shown in FIG. 1, production casing 12 is disposed inside casing 18 and usually extends for several thousand feet below the casing 18 to the producing formations. For convenience herein, it is referred to as the inner casing. Well 10 has a wellhead assembly 22 surmounted by a christmas tree 24. Wellhead 22 comprises a casing head 26 secured to the upper end of surface casing 18 by welding, for example, and an expansion spool 28 is mounted atop the casing head. Annulus valves 30 and 32 are provided on casing head 26 for fluid communication with an annulus cavity 34 formed between the portions of surface casing 18 and inner casing 12 above the cement level between the casings. Wing valves 36 and 38 are provided on expansion spool 28 for fluid communication with a cavity 40 inside the expansion spool. Christmas tree 24 includes a master valve 42, a flow tee or cross fitting 44, a valve 46 and a bull plug 48. The christmas tree configuration shown is illustrative only and may be changed to conform to the needs of a user. Further, inner casing 12 may be opened at the bottom or perforated to allow steam into the inner casing.

Figure 2:
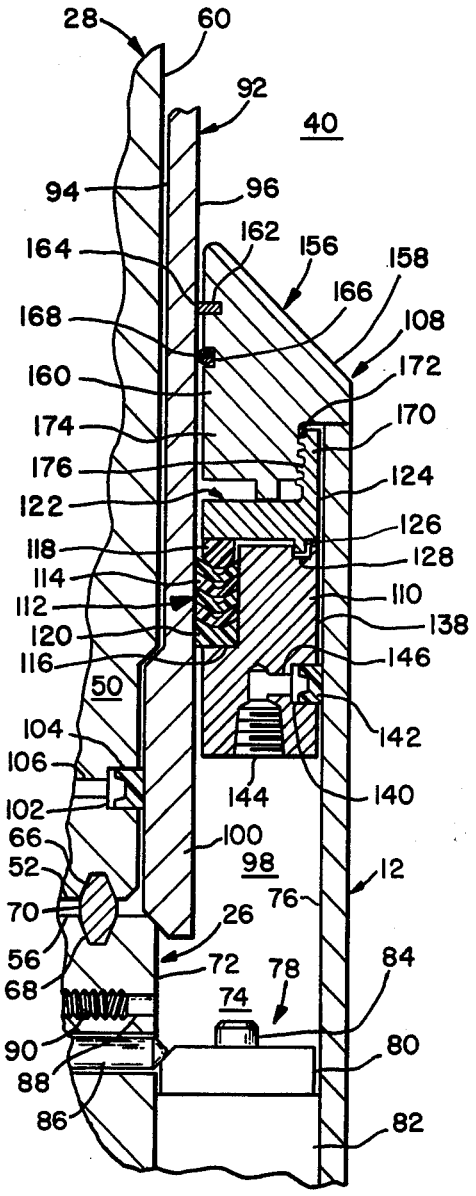
FIG. 2 is an enlarged partially cutaway elevational view of a portion of the wellhead illustrating a packing assembly of the present invention.
Figure 3:
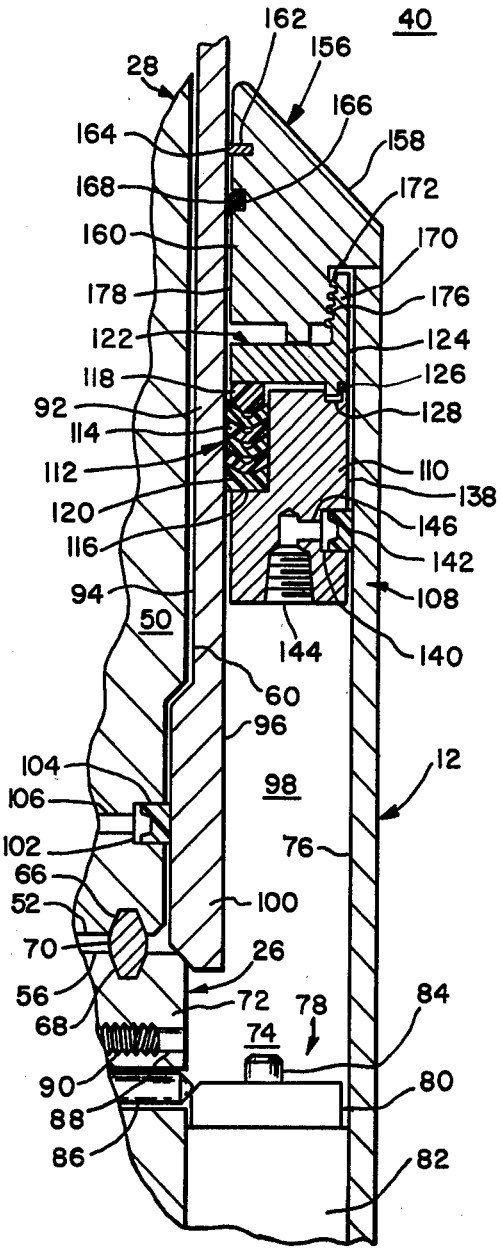
FIG. 3 is a view similar to FIG. 2 illustrating movement of the packing assembly with movement of the inner casing due to temperature changes in the wellhead.
Figure 10:
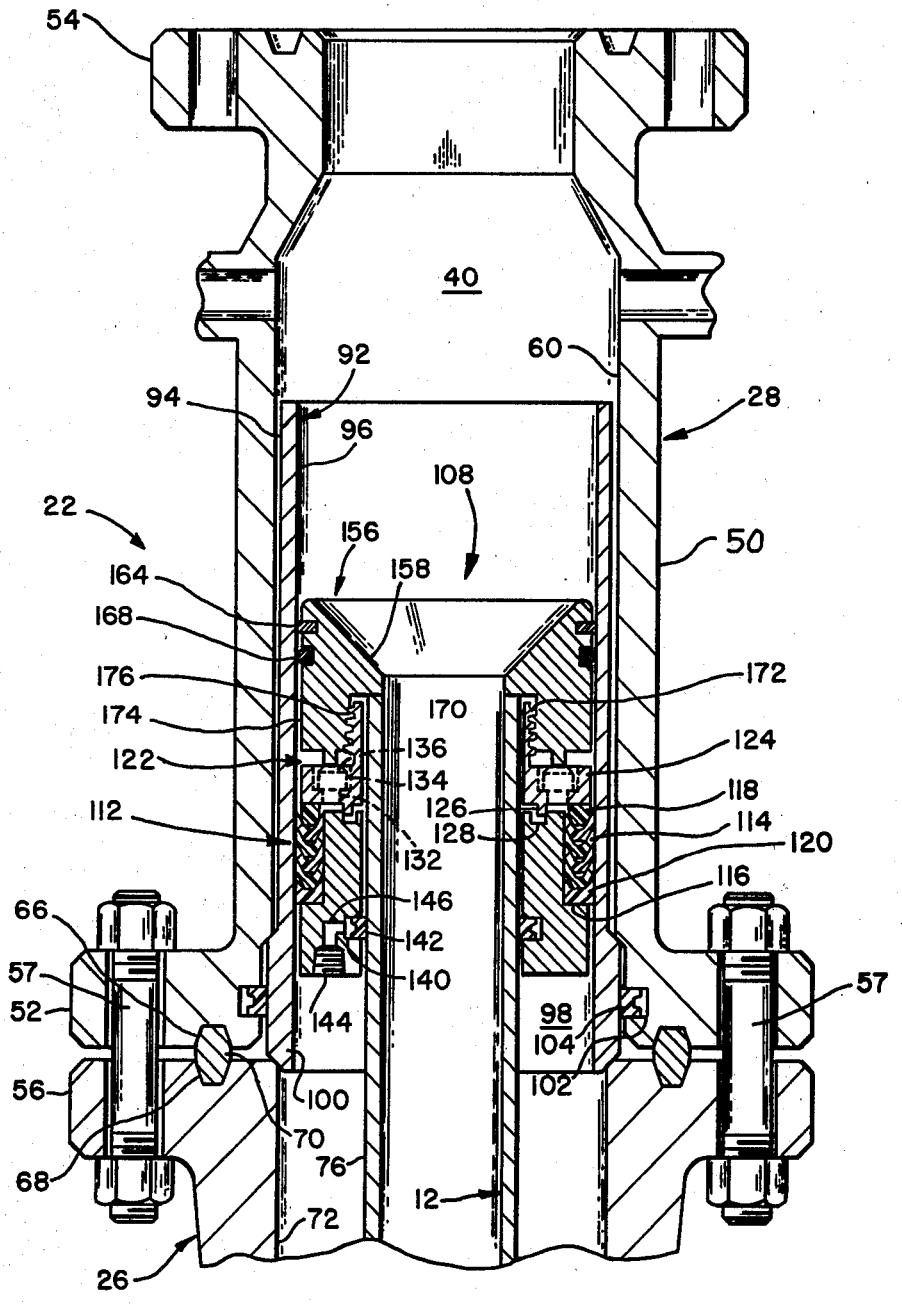
FIG. 10 is an elevational view of a portion of a geothermal wellhead illustrating the installation of an expansion sleeve in the wellhead.

Referring to FIGS. 1, 2 and 10, expansion spool 28 is a hollow member having an elongated center portion 50 with flanges 52 and 54 at its lower and upper ends, respectively. Flange 52 is attached to a flange 56 of casing head 26 by mounting bolts 57 (see FIG. 10). Similarly, flange 54 is attached to a flange 58 of christmas tree 24. The expansion spool is circular in cross-section and the inner wall or surface 60 of the expansion spool defines a spool cavity 40. A pair of opposed flanged outlets 62 and 64 are mounted through the side wall of the expansion spool below upper flange 54 to provide fluid communication with cavity 40 which is the upper end of the wellhead bore.

Flange 52 has a groove 66 in its lower face and flange 54 of casing head 26 has a corresponding groove 68 in its upper face. An oval ring gasket 70 fits in these grooves to seal the fluid connection between the casing head and expansion spool. The casing head is also circular in cross-section and has an inner wall or surface 72. An annular cavity 74 is defined by inner wall 72 of casing head 26 and an outer wall or surface 76 of inner casing 12. A centralizer assembly 78 fits into cavity 74 to center inner casing 12 in the wellhead bore. The centralizer assembly has an upper section 80 and a lower section 82. These sections are joined together by bolts 84, one of which is shown in FIG. 2. Additionally, holddown screws, such as the set screw 86 shown in FIG. 2, are used to compress upper section 80 of centralizer assembly 78 and urge it downwardly. A port 88 extends into cavity 74 through flange 56 of casing head 26. This port is, for example, used to test for fluid leakage from cavity 74, but is normally closed by a plug 90.

As shown in FIG. 1, the lower end portion of inner casing 12 is restrained while the upper end portion of the casing is unrestrained. Due to temperature changes within the wellhead, the inner casing expands and contracts along its longitudinal axis so the upper end of the casing may move up or down several inches within the wellhead and particularly within the cavity 40 defined by expansion spool 28. The distance which the inner casing moves depends upon temperature of the casing and the distance from the top of the cement 20 to the upper end of the casing.

As shown in FIGS. 1,2 and 10, an expansion sleeve 92 fits within expansion spool 28. Sleeve 92 is annular in cross-section and the outer wall 94 of the sleeve is immediately adjacent inner wall 60 of the expansion spool when the expansion sleeve is installed in wellhead 22. The inner wall or surface 96 of the expansion sleeve together with outer surface 76 of inner casing 12 defines an annular space 98. As shown in FIG. 10, the height of the expansion sleeve is such that it extends above the upper end of inner casing 12 at the farthest upward extension of the inner casing. Expansion sleeve 92 has a base section 100 which is thicker than the upper section thereof. Both the outer rim of the expansion sleeve base and the inner rim of the upper inner end of the casing head are beveled to provide seating surfaces for the expansion sleeve. Inner surface 96 of the expansion sleeve is honed or polished throughout the entire length of the sleeve to provide a better surface with which to effect a seal between the expansion sleeve and inner casing 12 as is described hereinafter. Inner wall 60 of expansion spool 28 has a circumferential groove 102 in which is installed a pressure seal 104. A port 106 extends through the expansion spool to groove 102 so seal 104 can be pressurized. Pressurization of seal 104 effects a seal between the expansion spool and the expansion sleeve.

A packing assembly 108 is installed in wellhead 22 in the annular space 98 defined by expansion sleeve 92 and inner casing 12. Packing assembly 108 extends in sealing relation between the expansion sleeve and inner casing and is movable with the upper end portion of the inner casing as it moves longitudinally in response to temperature changes in wellhead 22. Packing assembly 108 comprises a packing support ring 110 of generally annular shape which fits in the annular space between expansion sleeve 92 and inner casing 12. A packing means 112 comprises at least one packing member 114 carried by support ring 110. As shown in FIGS. 2–5, four packing members 114 are included in packing means 112. The packing members are V-shaped annular rings and are carried in a circumferential groove 116 formed at the outer upper margin of support ring 110. Alternate packing members have suitable high temperature sealing characteristics and suitable low temperature sealing characteristics. Packing members 114 are arranged in nested stacked configuration and are sandwiched between an upper adapter ring 118 and a lower adapter ring 120. These adapter rings have suitably contoured faces so to form a packing structure which is readily accommodated in groove 116.

Figure 4:
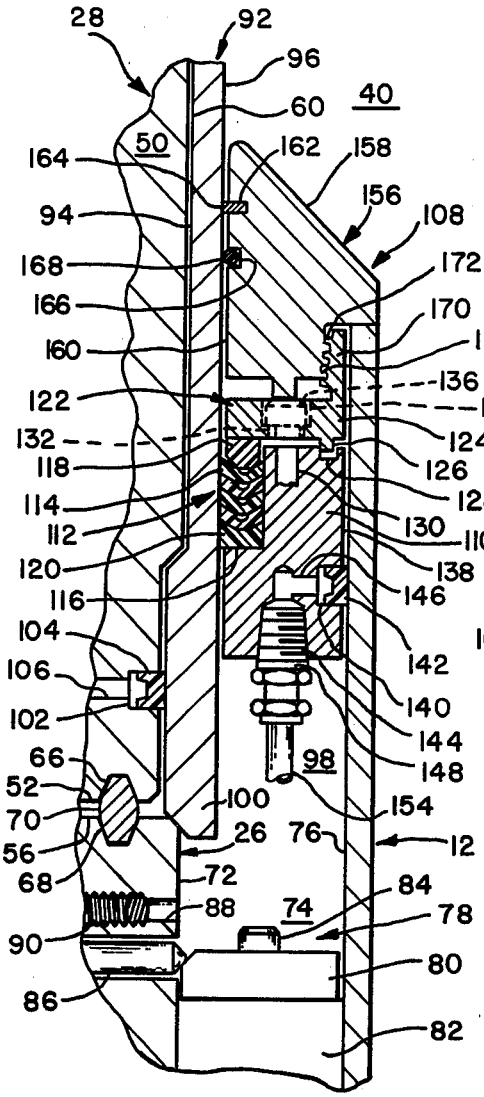
FIG. 4 is an elevational view similar to FIG. 2, illustrating a different section of the packing assembly shown in FIG. 2.
Figure 5:
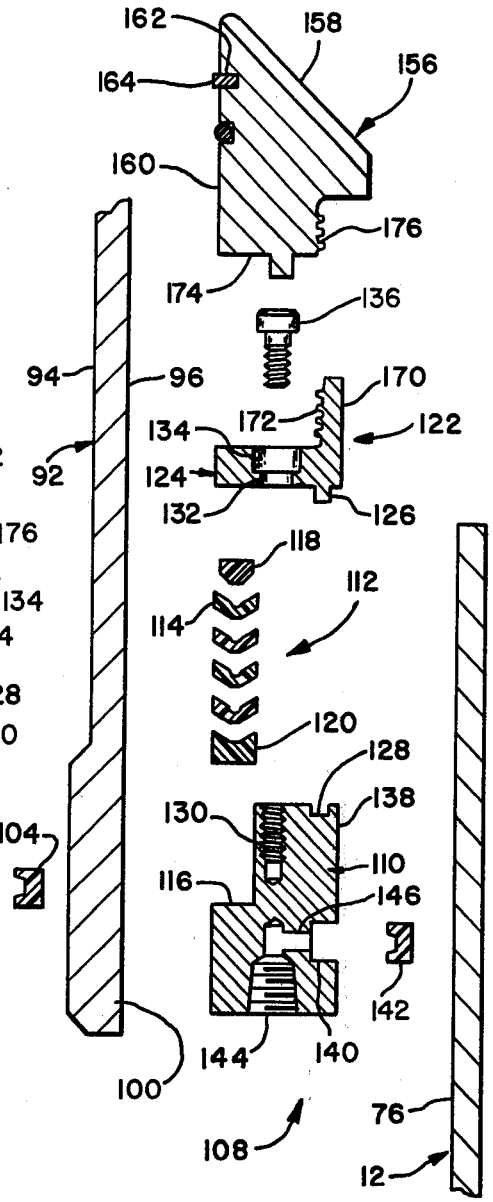
FIG. 5 is an exploded view of the packing assembly shown in FIG. 4.

Packing assembly 108 further includes a compressing means 122 for compressing the packing members 114 to effect a seal. Means 122 includes a circular plate 124 having a central circular opening sized so the plate fits around inner casing 12. The bottom of plate 124 abuts the upper surface of adapter 118. A circumferential shoulder 126 extends beneath the plate 124 and fits into a circumferential slot 128 in the top of packing support ring 110. As shown in FIGS. 4 and 5, packing support ring 110 has a threaded bore 130 extending into the ring from its upper surface. Plate 124 has a smooth bore 132 of corresponding diameter, the two bores being aligned when plate 124 is properly rotated with respect to ring 110. The upper end of bore 132 is counterbored as at 134. A threaded bolt 136 is threaded into bore 130 through bore 132 and as the bolt is tightened, plate 124 is drawn toward packing support ring 110. The bottom of plate 124 bears against the top of adapter 118 and compresses packing members 114 so they form a seal against the inner surface 96 of expansion sleeve 92. It will be understood that a number of bores 130 are spaced about the circumference of support ring 110, as are a corresponding number of bores 132 about plate 124. A bolt 136 is threaded into each threaded bore 130 through the bores 132 so to create a uniform compressive force on the stacked ring members around the circumference of the packing assembly. This, in turn, produces a uniform seal between the packing assembly and expansion sleeve. For each bolt the top thereof is co-planar with the top surface of the circular plate 124.

Figure 6:
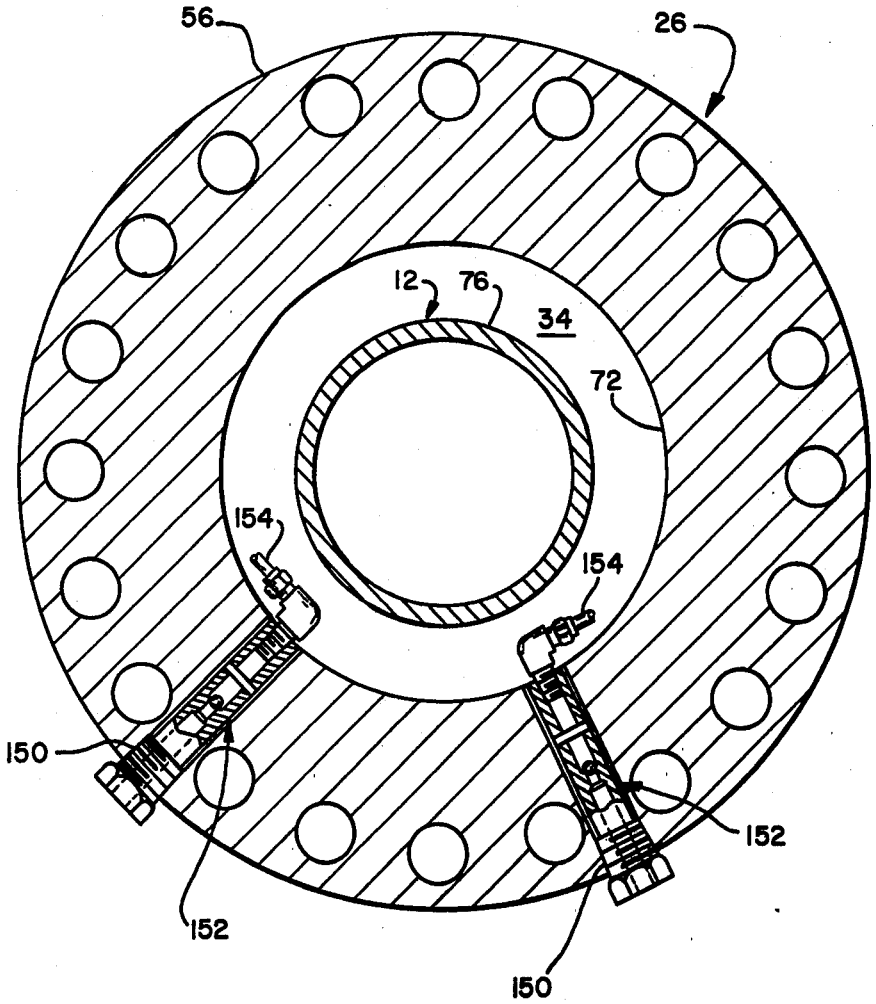
FIG. 6 is a cross-sectional view of the wellhead structure shown in FIG. 1 taken along line 6—6 in FIG. 1.

Inner face 138 of packing support ring 110 has a circumferential groove 140. An annular seal 142 fits in this groove. In addition, the packing support ring has a series of spaced apart, threaded injection ports 144 in its base and these ports communicate with groove 140 through radial passages 146. An injector 148 (see FIG. 4) is received in each port. Referring to FIG. 6, flange 56 of casing head 26 has a number of ports 150, two of which are shown in the drawing. Fluid injector fittings 152 are installed in each of these ports and are connected to injectors 148 by appropriate tubing 154. A plastic material is injected behind seal 142 through the fittings 152 and injectors 148 to pressurize the seal and force it against outer wall 76 of inner casing 12. A seal is thereby effected between packing assembly 108 and the inner casing and this seal, together with the seal effected by packing means 112, completes a seal between the inner casing and expansion sleeve 92.

Packing assembly 108 also includes a bit guide 156 which rests atop the upper end of inner casing 12. Bit guide 156 extends above the upper end of inner casing 12 and has a central circular bore, the diameter of which corresponds to the inner diameter (i.d.) of the inner casing. The bit guide has an inclined upper surface 158 which provides a smooth transition for fluid passing through inner casing 12 and entering cavity 40. Outer wall 160 of the bit guide has a first circumferential groove 162. A scraper ring 164 is received in this groove. Both groove 162 and scraper ring 164 are rectangular in cross-section and the scraper ring is constructed of a rigid and suitably hard material so it will scrape scale, rust, and other foreign matter off inner surface 96 of expansion sleeve 92. Surface 96 is polished, both to provide a better sealing surface for the seal formed by packing means 112, to better resist the build-up of scale and rust formation, and for whatever deposits that build up to be more easily removed by the scraping action of ring 164. Outer surface 160 of the bit guide has a second circumferential groove 166 and an O-ring seal 168 is received in this groove.

Bit guide 156 and plate 124 are coupled together. Plate 124 has an upstanding central hollow cylindrical section 170. The outer surface of this section is threaded as indicated at 172. Bit guide 156 has a cylindrical projection 174 extending below the upper surface of inner casing 12. The inner surface of this projection is threaded as indicated at 176. Threads 172 and threads 176 are mating threads which permit the bit guide and plate to be matingly coupled. Another annular cylindrical projection 175 is provided on the underside thereof to seat against the planar upper surface of the circular plate. Its radial location corresponds to that of the bolt 136 so that it, in effect, locks the bolt in place and thus the bolt is not allowed to loosen and allow the seals to be uncompressed.

The completed packing assembly effectively seals inner casing 12 from expansion sleeve 92. The seal produced is maintained throughout longitudinal movement of the unrestrained upper portion of the inner casing regardless of whether the movement is an expansion or contraction of the inner casing caused by temperature changes within wellhead 22.

The packing assembly of the present invention offers several advantages over previous assemblies. First, the assembly can be used with both an eight (8) inch and a fourteen (14) inch expansion per casing program. Second, the assembly permits use of a much shorter expansion spool than was previously used. For example, the overall height of the spool has been reduced from 48 inches to 34 inches and this is important in those wellhead structures where height is critical. Third, packing assembly of the present assembly is easier to install in a geothermal wellhead than other packing assemblies thereby reducing downtime for the rig. Fourth, the above features significantly reduce the cost of a wellhead packing structure.

Figure 7:
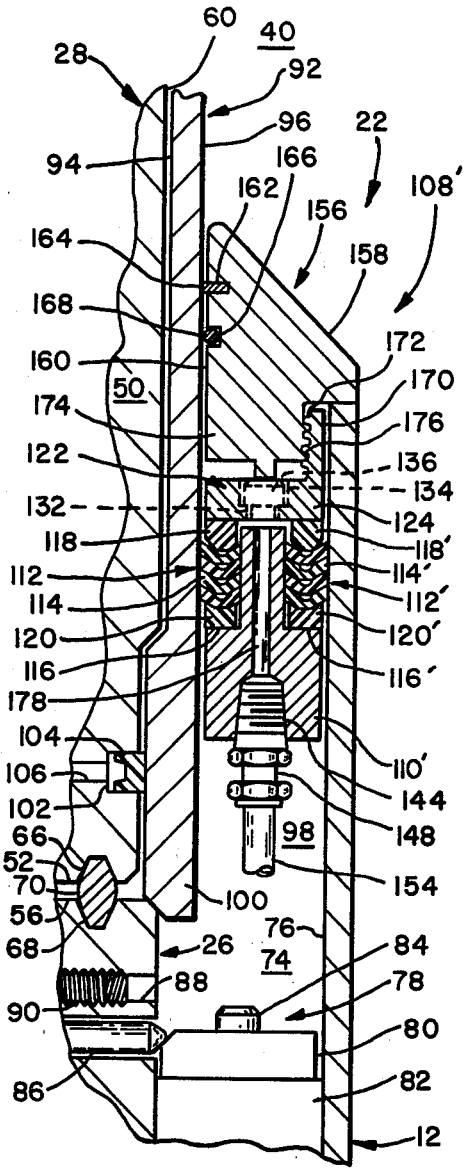
FIG. 7 is a view similar to FIG. 2 illustrating a second embodiment of the packing assembly of the present invention.
Figure 8:
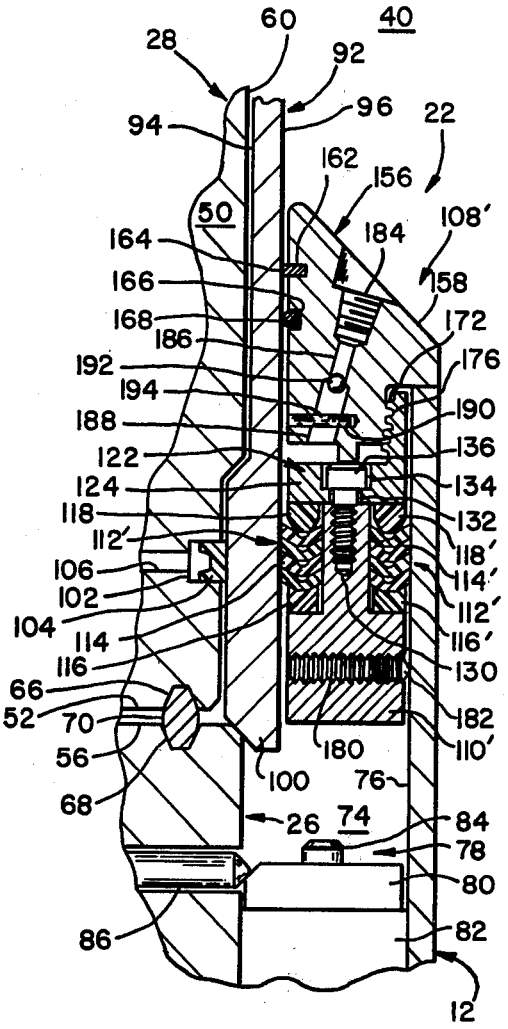
FIG. 8 is a view similar to FIG. 7 illustrating additional details of said second embodiment of the packing assembly of the present invention.

Referring to FIGS. 7 and 8, a second embodiment of the packing assembly is shown. This embodiment is designated 108' and includes a packing support ring 110' carrying a first packing means 112 which is the same as that previously described. Packing assembly 108' further includes a second packing means 112' comprising a plurality of annular packing members 114'. Packing support ring 110' has a second circumferential groove 116', this groove being formed about the upper inner margin of the ring. Packing members 114' are similar in construction to packing members 114 and are arranged in a nested stacked configuration in groove 116'. In addition to upper and lower adapters 118, 120, additional upper and lower adapters, 118' and 120', respectively, are used at the upper and lower ends of the stack. Plate 124 of compressing means 122 compresses packing means 112' together with packing means 112 when the plate is drawn toward the packing support ring by threaded bolt 136. When compressed, packing means 112' effects a seal between packing assembly 108' and outer wall 76 of inner casing 12. An injector 148 is received in port 144 and packing supporting ring 110' has a longitudinal passage 178 extending through the ring and opening into the space above the ring. Packing material such as a plastic packing or the like is injected through injector 148 to fill the annular space enclosed by packing means 112 and 112', a bit guide 156 and O-ring seal 168.

FIG. 8 illustrates another sectional view of the embodiment of FIG. 7. As seen in this view, packing support ring 110' has a radial threaded bore 180 in which is received a set screw 182. Set screw 182 is threaded through bore 180 and bites into outer surface 76 of inner casing 12. The set screw attaches the packing support ring to the inner casing. It will be understood that a number of set screws 182 are used to secure the packing support ring to the inner casing and that the same technique is used to secure packing support ring 110 (see FIGS. 2–5) to inner casing 12.

Bit guide 156 has a port 184 formed in inclined face 158. Port 184 extends downwardly and outwardly from face 158 and a passage 186 extends from the port through the bit guide and opens into the space below the bottom surface of the bit guide. Passage 186 is counterbored as indicated at 188 and a radial passage 190 extends inwardly from outer surface 160 of the bit guide across the enlarged portion of passage 186 created by counterbore 188. A ball check valve 192 fits into counterbore 188 and a pin 194 received in passage 190 retains the ball valve in the counterbore. Port 184 acts as a test port to determine if the fluid pressure produced by injecting packing material through passage 178 is sufficiently high. The material, as it fills the spaces outlined above, fills the lower portion of passage 186 and seats ball valve 192 to prevent the packing material from escaping through port 184. The packing material serves as both a sealing agent and a lubricant to facilitate movement of the packing assembly as it moves with inner casing 12.

Figure 9:
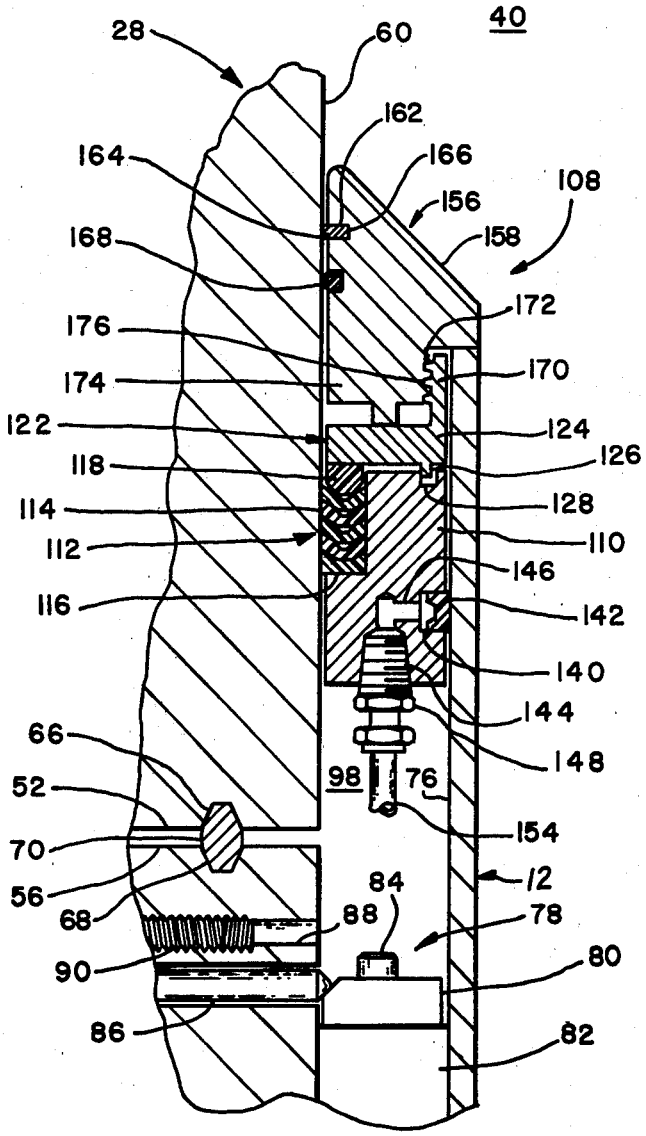
FIG. 9 is an enlarged partially cutaway elevational view of a wellhead illustrating a packing assembly of the present invention in a wellhead which does not include an expansion sleeve.

Referring to FIG. 9, packing assembly 108 is used in a wellhead 22 without an expansion sleeve 92. This application is best suited for use with an expansion spool of the straight bore type. In such an installation the packing assembly effects a seal between surface 76 of inner casing 12 and wall 60 of expansion spool 28. The relative sizes of packing support ring 110, compression plate 124, and bit guide 156 may differ from the similar components shown in FIGS. 2–8, however, there is no difference in the assembly or operation of the assembly 108 shown in FIG. 9 from that previously described.

FIG. 10 shows an installation of an expansion sleeve in a typical wellhead with which the invention is used. Although not shown, this installation includes a centralizer assembly for centering the inner casing in the well bore. For an application as described in FIG. 9, the expansion spool 28 would preferably have a straight bore.

In view of the above, it will thus be seen that the several objects of the invention are achieved and other advantageous results obtained.

As various changes could be made in the above construction without departing from the scope of the invention, it is intended that all matter contained in the above description and shown in the accompanying drawings shall be interpreted as illustrative and not in a limiting sense.

What is claimed is:

1. In a wellhead assembly having a casing head, an inner casing within the casing head, the inner casing having a restrained lower end portion and an unrestrained upper end portion extending above the casing head, and an expansion spool mounted on the upper end of the casing head and receiving the upper end portion of the inner casing:

an expansion sleeve fitting within the expansion spool, the outer surface of the expansion sleeve being adjacent the inner surface of the expansion spool and defining an annular space between the inner surface of the expansion sleeve and the outer surface of the inner casing;

and a packing assembly mounted within the annular space on the upper end portion of the inner casing and extending in sealing relation between the inner casing and the expansion sleeve, said packing assembly being movable with the upper end portion of the inner casing relative to the expansion spool and expansion sleeve as the inner casing moves longitudinally in response to temperature changes within the wellhead assembly.

2. The apparatus of claim 1 wherein the packing assembly has a packing means for effecting a seal between the expansion sleeve and the inner casing.

3. The apparatus of claim 2 wherein the packing assembly includes a packing support ring fitting within the annular space defined by the inner surface of the expansion sleeve and the outer surface of the inner casing.

4. The apparatus of claim 3 wherein the packing means comprises at least one packing member carried by the packing support ring at the upper end thereof, the packing assembly further including means for compressing the packing member to effect the seal.

5. The apparatus of claim 4 wherein the packing assembly further includes an annular guide resting atop the upper end of the inner casing, the compression means coupling with the guide and being movable relative thereto to exert a pressure on the packing means sufficient to effect the seal.

6. The apparatus of claim 4 wherein the packing means comprises a set of annular packing members arranged in adjacent relation, alternate packing members having suitable high temperature sealing characteristics and suitable low temperature sealing characteristics.

7. The apparatus of claim 6 wherein the packing support ring has an annular groove formed about its outer margin and the packing members are fitted in the groove in a stacked arrangement, the packing means, when compressed, sealing against the inner surface of the expansion sleeve.

8. The apparatus of claim 7 further including an annular seal carried by the packing support ring and means for pressurizing the seal whereby it seals against the outer surface of the inner casing.

9. The apparatus of claim 5 wherein the compressing means comprises a circular plate with an upstanding central hollow cylindrical section fitting over the upper end of the inner casing, the outer surface of the cylindrical section being threaded.

10. The apparatus of claim 9 wherein the guide has a cylindrical projection extending below the upper surface of the inner casing, the inner surface of the cylindrical projection having mating threads for threadably coupling the compressing means and the guide and for allowing the compressing means to move relative to the guide.

11. The apparatus of claim 1 wherein the inner surface of the expansion sleeve is polished and the height of the sleeve is greater than the highest extension of the inner casing produced by temperature changes.

12. The apparatus of claim 6 wherein the packing means includes a second set of annular packing members carried by the packing support ring at the upper end thereof, the second set of packing members being arranged in adjacent relation with alternate packing members of the second set having suitable high temperature sealing characteristics and suitable low temperature sealing characteristics.

13. The apparatus of claim 12 wherein the packing support ring has a second annular groove, the second annular groove being formed about the inner margin of the ring and the second set of packing members being fitted in this second groove in a stacked arrangement, the second set of packing members, when compressed, sealing against the outer surface of the inner casing.

14. A packing assembly for a geothermal wellhead having a casing head, an inner casing within the casing head, the inner casing having a restrained lower end portion and an unrestrained upper end portion extending above the casing head, an expansion spool mounted on the upper end of the casing head and receiving the upper end portion of the inner casing and means for guiding the inner casing upon longitudinal movement thereof relative to the casing head, the packing assembly comprising:

a packing support ring fitting within the annular space defined by the inner surface of the expansion spool and the outer surface of the inner casing;

packing means carried by the support ring for effecting a seal between the expansion spool and the inner casing;

means for compressing the packing means to effect the seal; and a guide resting atop the upper end of the inner casing and coupled with the compressing means, the compression means being movable relative to the support ring to compress the packing means whereby a seal is effected between the inner surface of the expansion spool and the outer surface of the inner casing, the seal being maintained throughout longitudinal movement of the inner casing resulting from temperature changes within the wellhead.

15. A packing assembly as set forth in claim 14 wherein the packing means comprises a plurality of packing members carried by the support ring at the upper end thereof.

16. A packing assembly as set forth in claim 15 wherein the packing members comprise a set of annular packing members arranged in adjacent relation, alternate packing members having suitable high temperature sealing characteristics and suitable low temperature sealing characteristics.

17. A packing assembly as set forth in claim 16 wherein the packing support ring has an annular groove formed about its outer margin and the packing members are fitted in the groove in a stacked arrangement, the packing means, when compressed, sealing against the inner surface of the expansion sleeve.

18. The apparatus of claim 17 further including an annular seal carried by the packing support ring and means for pressurizing the seal whereby it seals against the outer surface of the inner casing.

19. The packing assembly of claim 14 wherein the compressing means comprises a circular plate with an upstanding central hollow cylindrical section fitting over the upper end of the inner casing, the outer surface of the cylindrical section being threaded.

20. The packing assembly of claim 19 wherein the guide has a cylindrical projection extending below the upper surface of the inner casing, the inner surface of the cylindrical projection having mating threads for threadably coupling the compressing means and the guide.

21. The packing assembly of claim 16 wherein the packing means includes a second set of annular packing members arranged in adjacent relation, alternate packing members of the second set having suitable high temperature sealing characteristics and suitable low temperature sealing characteristics.

22. The packing assembly of claim 21 wherein the packing support ring has a second annular groove at its upper end, the second annular groove being formed about the inner margin of the ring and the second set of packing members being fitted in this second groove in a stacked arrangement, the second set of packing members, when compressed, sealing against the outer surface of the inner casing.

23. In a packing assembly for a geothermal wellhead, the wellhead including a casing head, an inner casing within the casing head, the upper end portion of the inner casing being unrestrained, and an expansion spool mounted on the upper end of the casing head and receiving the upper end portion of the inner casing;

said packing assembly being mounted on the upper end portion of the inner casing for longitudinal movement therewith relative to said expansion spool and comprising:

a packing support ring fitting within the annular space defined by the inner surface of the expansion spool and the outer surface of the inner casing and a packing structure comprising at least one annular packing member carried by the packing support ring at the upper end thereof;

an annular guide resting atop the upper end of the inner casing above the packing support ring; compressing means for exerting a compressive force on the packing member to effect a seal between the expansion spool and the inner casing;

and means for coupling the compressing means and the guide with the seal compressing means being movable relative to the guide so to exert compressive force on the packing member and thereby to effect a seal between the expansion spool and inner casing, the seal being maintained throughout longitudinal movement of the casing head resulting from temperature changes within the wellhead.

24. The apparatus of claim 23 wherein the compressing means comprises a circular plate with an upstanding central hollow cylindrical section fitting over the upper end of the inner casing.

25. The apparatus of claim 24 wherein said annular guide is a bit guide which has a cylindrical projection extending below the upper surface of the inner casing.

26. The apparatus of claim 25 wherein the coupling means comprises threads formed on the outer surface of the cylindrical section of the compressing means and mating threads formed on the inner surface of the cylindrical projection of the guide whereby the compressing means and guide are threadably coupled with the compression means being movable relative to the guide.

27. A wellhead assembly comprising a casing head; an inner casing within the casing head, the inner casing having a restrained lower end portion and an unrestrained upper end portion extending above the upper end of the casing head; an expansion spool mounted on the upper end of the casing head and extending thereabove, the upper end portion of the inner casing being received in the expansion spool; and, an expansion sleeve fitting within the annular space defined by the expansion spool and the inner casing, the expansion sleeve and inner casing defining a second and smaller annular space in which a packing assembly is accommodated, said packing assembly being secured to the outer peripheral surface of the inner casing for longitudinal movement with said inner casing relative to said expansion spool and said expansion sleeve, the packing assembly effecting a seal between the expansion sleeve and the inner casing which is maintained throughout longitudinal movement of the inner casing relative to the casing head due to temperature changes within the wellhead.

28. The wellhead assembly of claim 27 wherein the outer surface of the expansion sleeve is adjacent the inner surface of the expansion spool and the length of the sleeve is such that the upper end of the inner casing cannot rise above it.

29. The wellhead assembly of claim 28 wherein the wall thickness of the expansion sleeve is relatively small compared to the diameter of the annular space defined by the expansion spool and inner casing and the inner surface of the sleeve is polished to provide a better surface for the packing assembly to form a seal against.

30. The wellhead assembly of claim 29 wherein the base section of the expansion sleeve is thicker than the upper section thereof and the base of the sleeve seats against the top of the casing head.

* * * * *